United States Patent [19]

Murai et al.

[11] 4,143,680

[45] Mar. 13, 1979

[54] CONCEALED SLIDE FASTENER

[75] Inventors: Ryukichi Murai, Toyama; Noritaka Tubata, Uozu, both of Japan

[73] Assignee: Yoshida Kogyo K.K., Japan

[21] Appl. No.: 906,916

[22] Filed: May 17, 1978

[30] Foreign Application Priority Data

May 18, 1977 [JP] Japan ..... 52-63377[U]

[51] Int. Cl.[2] ..... A44B 19/32; A44B 19/42

[52] U.S. Cl. ..... 139/384 B; 24/205.1 C

[58] Field of Search ..... 24/205.16 C, 205.1 C, 24/205.1 R; 139/384 B

[56] References Cited

U.S. PATENT DOCUMENTS 3,900,928 8/1975 Takamatsu ..... 24/205.1 C 4,058,145 11/1977 Frohlich ..... 139/384 B

*Primary Examiner*—Bernard A. Gelak

*Attorney, Agent, or Firm*—Hill, Gross, Simpson, Van Santen, Steadman, Chiara & Simpson

[57] ABSTRACT

A concealed slide fastener comprising an engageable pair of stringers individually consisting of a woven fabric tape and an element attached along a side edge portion of the tape, in which employed for the warp yarn woven in at such a portion of the tape which substantially corresponds to the center of a coupling head of the element and along which the tape is double folded is finer than the warp yarn woven in the rest portion of the tape, for an improved ease and accuracy of the tape folding and also an improved fastener concealing performance.

1 Claim, 5 Drawing Figures

CONCEALED SLIDE FASTENER

BACKGROUND OF THE INVENTION

The present invention relates to a concealed slide fastener of the type in which the member normally referred to simply as element is attached along a side edge portion of a woven fabric tape, which is longitudinally double folded with the element projected on the turned-over or concealed side of the folded tape.

Slide fasteners of the type mentioned have been publicly known since before, which individually have a crosssectional configuration or structure as illustrated in FIG. 1 of the accompanying drawings: A pair of woven fabric tapes 1A and 1B respectively have elements 2A and 2B of for example a coil-like structure attached by sewing with threads 3A and 3B along a side edge portion respectively thereof to compose an engageable pair of fastener stringers fA and fB. Elements 2A and 2B respectively have coupling heads 4A and 4B, which are mutually engaged or meshed and tapes 1A and 1B are respectively double folded as illustrated, with the portions 5A and 5B as points of folding, which abut against each other at the engaged point or portion 6 where the elements 2A and 2B are visually concealed when the fastener is attached to clothing or the like.

With the conventional fastener stringers having the above structure, various shortcomings are indicated. For example, it often tends to occur that tapes 1A and 1B are folded with the point of the folding deviated in either side or lateral direction from a reference point or the abutting point 6, so that there becomes a difference produced between the point 6 and the center of the coupling of the heads 4A and 4B as shown in FIG. 1. Otherwise, as shown in FIG. 2, it is difficult to have the fastener tapes 1A and 1B satisfactorily folded or turned over about their respective points of folding 5A and 5B.

BRIEF SUMMARY OF THE PRESENT INVENTION

It is contemplated in the present invention to have elucidated the causes of such difficulties with the conventional devices and develop means for solution, to there obtain an improved and desirable concealed slide fastener.

The object of the present invention is therefore to provide a desirable concealed slide fastener, with which on folding the tape, it can be folded without fail and exactly about the point of folding, and in addition, the point at which the folded edge portions of the pair of stringer tapes abut against each other can substantially correspond to the center of the element heads to provide the desired fastener having a complete effect or performance of concealing.

DESCRIPTION OF THE PREFERRED EMBODIMENT

The aforementioned object of the present invention is attained by providing a reduced thickness portion or thinner portion extending the entire length of the woven fabric tape of a concealed type slide fastener having the element along a side edge portion of the tape, by weaving in a few runs of a warp yarn finer than the rest of the warp yarns woven in the tape, about the portion of the tape about which the tape is longitudinally double folded and which substantially corresponds to the center of coupling heads of the element when the tape is double folded.

Figure 1:
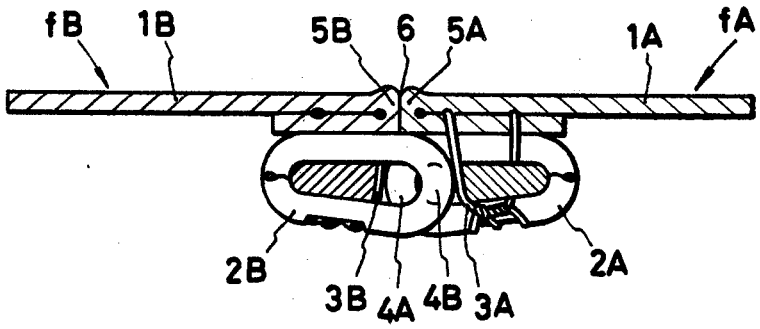
FIGS. 1 and 2 are respectively a crosssectional view of a conventional concealed slide fastener.
Figure 2:
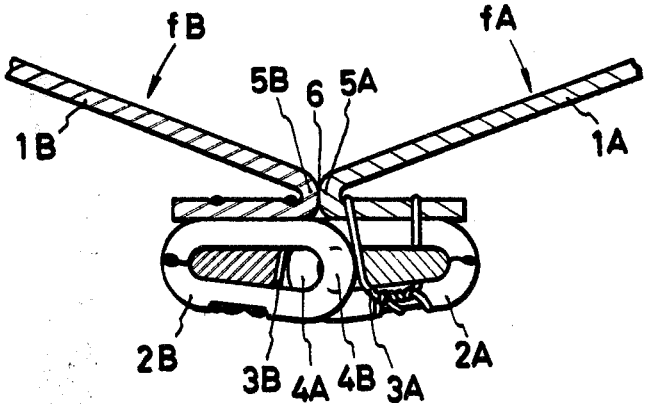
Figure 3:
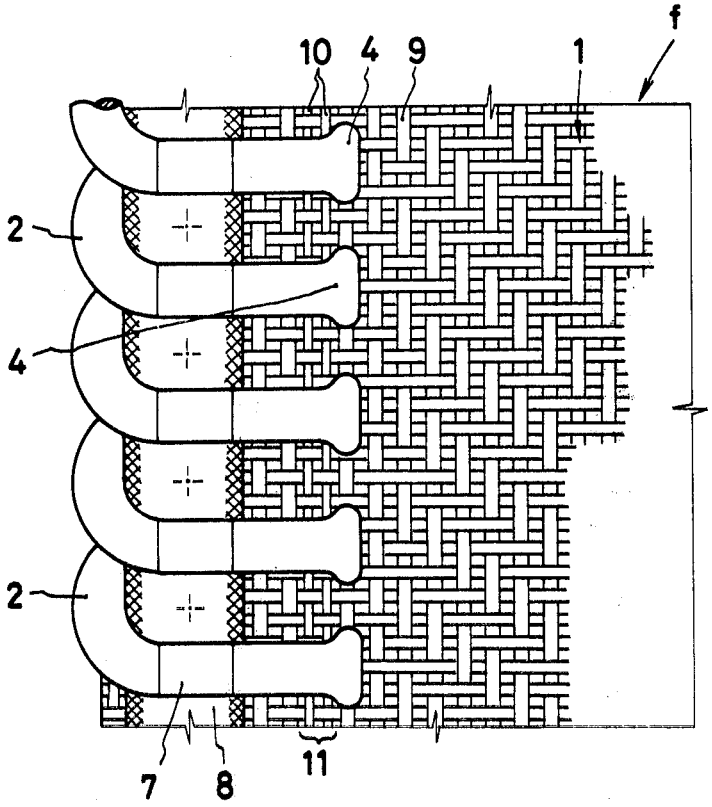
FIG. 3 is a top plan view, showing the stringer of a concealed slide fastener in accordance with the present invention in a condition in which the tape member of the fastener is not yet double folded and with the sewing thread removed away.
Figure 4:
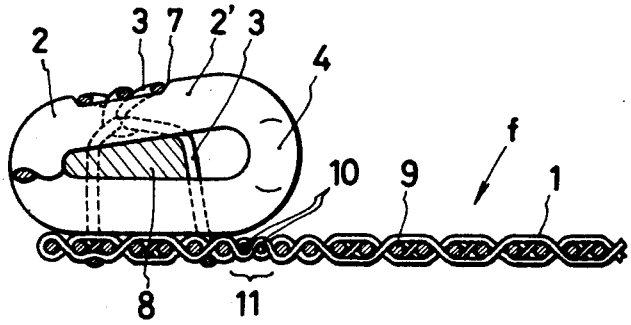
FIG. 4 shows a crosssectional view of FIG. 3.

Now, with reference to FIGS. 3–5 of the accompanying drawings, the structure of the concealed slide fastener according to the present invention will be described in greater detail.

The constituent members and structural features of the slide fastener of the present invention per se are mostly and generally the same as those of the conventional slide fasteners. That is to say, the fastener device of the present invention broadly comprises a pair of engageable stringers, and each stringer which is indicated at f comprises a woven fabric tape 1 and an element 2 attached to the tape 1 along a side edge portion thereof by sewing with thread 3, by for example double locked stitch. (In FIG. 3, the sewing thread 3 is removed away for simplicity of illustration.) The element 2 has a leg portion 2', which has provided on an outer surface portion thereof a groove 7 for receiving the thread 3 therein and preventing the same from slipping. In sewing the coil element 2 to tape 1, the thread 3 is applied through a cord 8 which is inserted into the coil elements.

A point whereby the device of the present invention is clearly and most essentially differentiated from the conventional ones consists in that the tape 1 has a particular woven texture facilitating an easy and accurate folding of the tape:

With the fastener according to the present invention, the tape 1 forming a member of the stringer f is so formed as to have a thickness reduced or thinner texture portion transversely at a portion thereof with which as the point of folding the tape is folded and which substantially corresponds to the center of the coupling head 4 of the element 2. The thinner texture portion, which is indicated at 11, is provided by employing in weaving the tape 1 a few runs of a warp yarn 10 which is finer in gauge than the yarn 9 woven in for the rest portion of the tape, and it is provided throughout the length of the tape. Onto the left side edge portion of the tape 1 in FIG. 3, the element 2 is attached by sewing in a manner such that the center of the coupling head 4 is substantially registered with the location of the thinner texture portion 11, in the warpwise direction of the tape. Then, the tape 1 is double folded with the thinner portion 11 as the line of folding to there provide a fastener stringer in accordance with the present invention.

Figure 5:
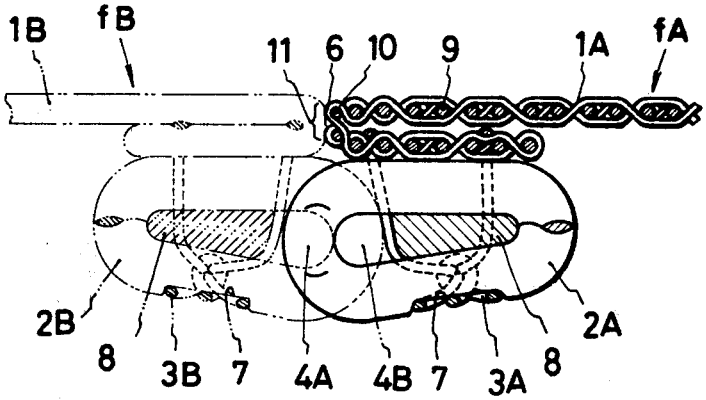
FIG. 5 similarly is a crosssectional view, showing a concealed slide fastener of the present invention in its finished condition.

Illustrated in FIG. 5 are a pair of fastener stringers fA and fB of which the elements 2A and 2B are in a coupled condition. As shown, the slide fastener according to the present invention has with its tape member 1 the thinner texture portion 11 formed by employment of finer warp yarns woven in than the warp yarns woven in for the other portion of the tape, so that even if the tape is folded in accordance with any known method, it can be folded with more ease at the thinner portion 11 than at any other portion thereof. Therefore, the thinner portion 11 functioning as the guide line for the tape folding, the tape can be accurately folded, in a straight line in the lengthwise direction thereof.

Accordingly, with the concealed slide fastener of the present invention, of which the tape member has a thinner portion of a line in the lengthwise direction for ease and accuracy of folding thereof as before stated, the linear abutting portion of each of the engaging pair of tapes can substantically completely correspond to the line of the center of the coupling heads of the two elements, and the fastening or unfastening operation by a slider (not shown) can be smoothly performed. Further, when the tape is folded, the few runs of a finer yarn woven in the abutting portion of the tape protrudes in the transverse direction beyond the outer edge of the folded tape corresponding to the center of the coupling heads, and the thinner yarns of one of the mutually engaging two tapes can press abut against the thinner yarns of the other tape, so that in the fastened condition of the two stringers, there can be no clearance left present between the abutting portions of the tapes. Thus, the fastener of the present invention can demonstrate a satisfactory concealing characteristic.

The concealed slide fastener of the present invention has a further point of improvement made: Whereas the diamond of the slider (not shown) operatively associated with the element in the fastener is projected outside of the abutting portion of the tape, the abutting portion is thin with respect to the warp yarn woven therein and thus can have a reduced area of its contact with the diamond in comparison to the comparable area of the conventional fastener device, so that the slider can be operated to slidably move at an advanced degree of smoothness.

What is claimed is:

1. A concealed slide fastener comprising an engageable pair of fastener stringers individually consisting of a woven fabric tape and an element attached along a side edge portion of said tape, characterized in that said woven fabric tape has a thinner portion about which the warp yarn woven therein in a few runs is finer than the warp yarns woven in the rest portion thereof, said thinner portion being formed transversely at a portion of the tape which substantially corresponds to the center of the coupling heads of the element and at which the tape is folded, and longitudinally through the entire length of the tape.

* * * * *